US006905562B2

(12) United States Patent
Hamilton

(10) Patent No.: US 6,905,562 B2
(45) Date of Patent: Jun. 14, 2005

(54) LOW DENSITY SLURRY BRIDGE MIX

(75) Inventor: Brian K. Hamilton, Ogden, UT (US)

(73) Assignee: Autoliv ASP, Inc., Ogden, UT (US)

( * ) Notice: Subject to any disclaimer, the term of this patent is extended or adjusted under 35 U.S.C. 154(b) by 49 days.

(21) Appl. No.: 10/655,200

(22) Filed: Sep. 4, 2003

(65) Prior Publication Data

US 2005/0067071 A1 Mar. 31, 2005

(51) Int. Cl.[7] ..... C06B 33/12; C06B 29/02
(52) U.S. Cl. ..... 149/40; 149/42; 149/77
(58) Field of Search ..... 149/37, 40, 41, 149/77, 108.6, 42, 43, 44

(56) References Cited

U.S. PATENT DOCUMENTS

| | | | | |
|---|---|---|---|---|
| 3,570,403 A | * | 3/1971 | Hawley et al. | 102/202.9 |
| 3,682,096 A | | 8/1972 | Lüdke et al. | |
| 3,899,973 A | * | 8/1975 | Brocart | 102/275.5 |
| 4,428,292 A | | 1/1984 | Riggs | |
| 4,729,315 A | | 3/1988 | Proffit et al. | |
| 4,869,170 A | * | 9/1989 | Dahmberg et al. | 102/202.5 |
| 4,976,200 A | | 12/1990 | Benson et al. | |
| 5,178,547 A | | 1/1993 | Bonas et al. | |
| 5,648,634 A | | 7/1997 | Avory et al. | |
| 5,678,163 A | | 10/1997 | Rice | |
| 5,686,691 A | | 11/1997 | Hamilton et al. | |
| 5,889,228 A | * | 3/1999 | Ewick et al. | 102/275.5 |
| 5,988,069 A | | 11/1999 | Bailey | |
| 6,009,809 A | | 1/2000 | Whang | |
| 6,073,963 A | | 6/2000 | Hamilton et al. | |
| 6,145,876 A | | 11/2000 | Hamilton | |
| 6,167,808 B1 | | 1/2001 | Mramor | |
| 6,176,517 B1 | | 1/2001 | Hamilton et al. | |
| 6,262,875 B1 | | 7/2001 | Albrecht et al. | |
| 6,274,252 B1 | | 8/2001 | Naugler et al. | |
| 6,276,953 B1 | | 8/2001 | Gauker et al. | |
| 6,334,917 B1 | | 1/2002 | Hamilton et al. | |
| 6,422,146 B1 | | 7/2002 | Vetter | |
| 6,516,724 B2 | | 2/2003 | Maier et al. | |
| 2002/0117070 A1 | | 8/2002 | Hatzl et al. | |

FOREIGN PATENT DOCUMENTS

| | | |
|---|---|---|
| DE | 299 15 056 U1 | 3/2000 |
| DE | 200 20 098 U1 | 5/2001 |

* cited by examiner

*Primary Examiner*—Aileen Felton
(74) *Attorney, Agent, or Firm*—Sally J. Brown

(57) ABSTRACT

A low density slurry bridge mix for use in an inflatable restraint system is provided. The low density slurry bridge mix includes zirconium metal, a thermal conductivity enhancer such as aluminum metal, potassium perchlorate oxidant, and a binder material and has a dry density of about 45 to about 65 percent of theoretical density. The low density slurry bridge mix may be used in an initiator including an unground header attached to a raised bridgewire wherein the low density slurry bridge mix surrounds and adheres to the bridgewire.

27 Claims, 1 Drawing Sheet

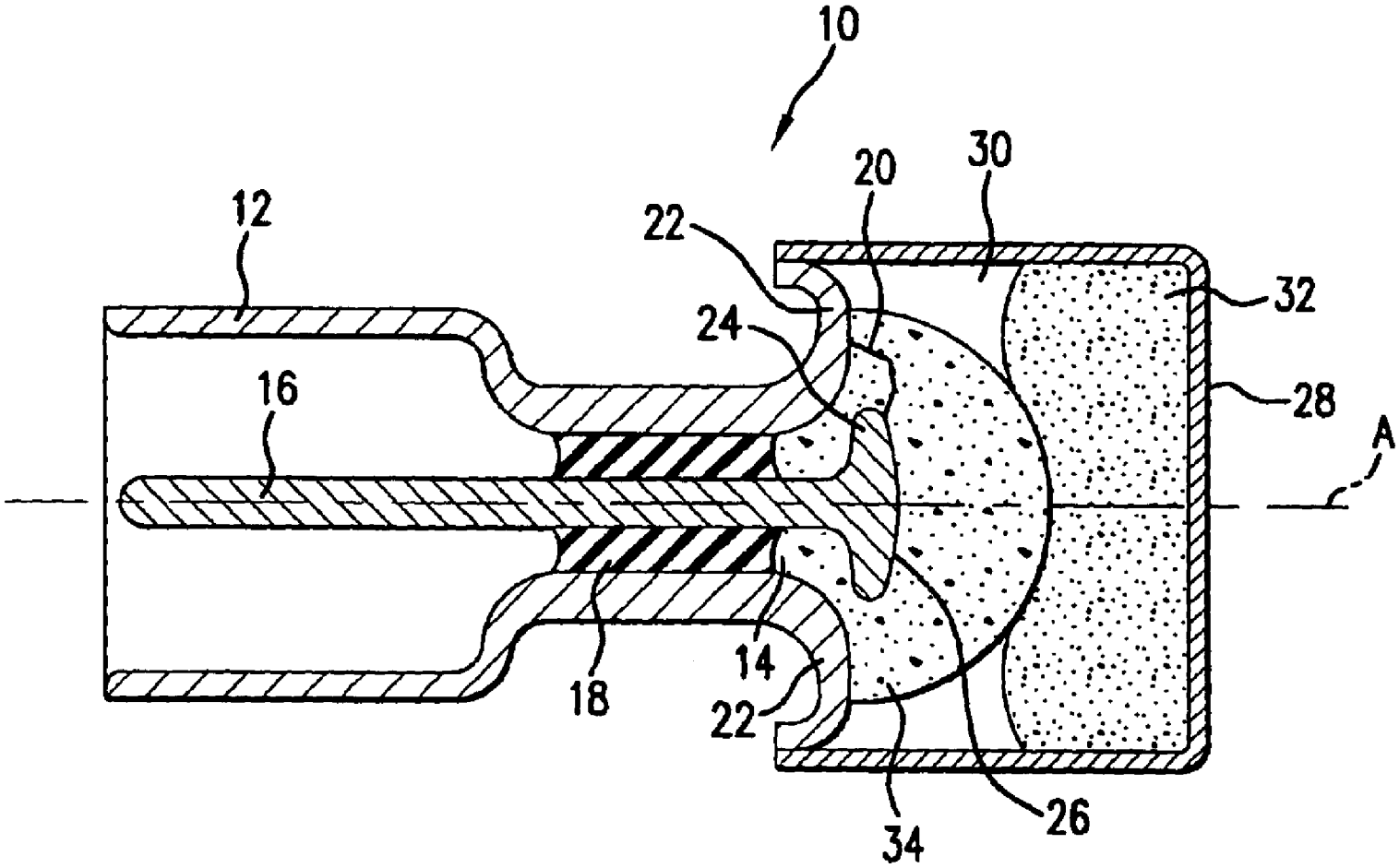
10
12
16
18
14
22
24
22
20
30
32
28
A
26
34

LOW DENSITY SLURRY BRIDGE MIX

BACKGROUND OF THE INVENTION

This invention relates generally to a bridge mix such as for use in an initiator such as for an inflator device for an inflatable restraint system. More particularly, the invention relates to a low density slurry bridge mix that may more readily adhere to a bridgewire.

It is well known to protect a vehicle occupant using a cushion or bag, e.g., an "airbag cushion" that is inflated or expanded with a gas when a vehicle experiences a sudden deceleration, such as in the event of a collision. Such airbag restraint systems normally include: one or more airbag cushions, housed in an uninflated and folded condition to minimize space requirements; one or more crash sensors mounted on or to the frame or body of a vehicle to detect sudden deceleration of the vehicle; an activation system electronically triggered by the crash sensors; and an inflator device that produced or supplies a gas to inflate the airbag cushion. In the event of a sudden deceleration of the vehicle, the crash sensors trigger the activation system which in turn triggers the inflator device which begins to inflate the airbag cushion in a matter of milliseconds.

Many types of inflator devices have been disclosed in the art for inflating one or more inflatable restraint system airbag cushions. Such inflator devices typically include: an igniter assembly or initiator; multiple combustible pyrotechnic compositions; and a housing for containing the initiator and the one or more pyrotechnic compositions. The initiator generally includes a header having one or more electrically conductive pins connected to a bridgewire to form a closed electrical circuit. The bridgewire is maintained in intimate contact with an electrically ignitable initiator charge or bridge mix that is held or maintained within a welded metal sleeve or charge holder. In the event of a collision, the activation system directs an electrical current through the conductive pins of the initiator to the bridgewire. The bridgewire ignites the initiator charge or bridge mix which in turn ignites an associated pyrotechnic composition such as an igniter composition or a gas generant composition to begin production of inflation gas and, thereby, inflation of an associated or corresponding airbag cushion.

Currently available automotive initiators commonly include a glass-to-metal sealed header or bridge, a welded bridgewire on a ground surface or other resistive heating device such as a thin film resistor or semi-conductor bridge, and a metal-oxidant pyrotechnic mixture or bridge mix. Typical bridgewires used in such automotive initiators have a relatively fine diameter, e.g., on the order of about 15 microns to about 40 microns. Such initiators also typically include a metal sleeve or charge holder adjoined to the header to contain the metal-oxidant bridge mix.

One metal-oxidant bridge mix that has been used in such automotive initiators includes a pyrotechnic composition containing a mixture of zirconium metal and potassium perchlorate with a polymeric binder, generally referred to as a ZPP mixture or composition. In order for such ZPP mixtures to function properly, the mixture is typically deposited on the bridge either as a granular powder or as a slurry and then compacted to a high percentage of its theoretical density e.g., about 80 to 95 percent of theoretical density. In general, the zirconium/potassium perchlorate or ZPP mixture is compacted to such a high percentage of its theoretical density because lower density ZPP mixtures may not conduct heat generated by the bridge sufficiently fast enough to meet stringent industry initiator sensitivity requirements and therefore may not reliably ignite an associated pyrotechnic composition to initiate inflation of an associated airbag cushion.

Typically, such currently available automotive initiators are produced by welding a charge holder to a header that includes a welded bridgewire, loading a ZPP mixture into the charge holder over the bridgewire and then pressing or compacting the ZPP mixture onto the bridgewire. In order to protect and support the bridgewire during the pressing or compacting process, the header is typically ground flat to within a small fraction of the diameter of the bridgewire. Pressing the bridgewire against this flat surface also provides a conductive heat sink that assists in lowering the sensitivity of the initiator. Generally, competitive conditions within the automotive safety restraint system industry make it desirable to produce such initiators at a lower cost than current designs, especially for the seat belt pretensioner market. However, manufacture or production steps such as providing and welding a charge holder to the header, properly grinding the header to provide support and protection to the relatively fragile bridgewire, and compacting the bridge mix to a desirably density add expense to the manufacturing process.

In view of the above, there is a need and a demand for an initiator that is more cost-effective to manufacture than commercially available initiators. In particular, there is an need or demand for a low density slurry bridge mix for use in such an initiator that is effective to reproducibly and reliably ignite an associated pyrotechnic composition. There is a further need or demand for a low density slurry bridge mix that may more readily adhere to a raised bridgewire thereby eliminating the need for providing and welding a charge holder to a header that has been ground to provide support and a heat sink for the bridgewire.

SUMMARY OF THE INVENTION

A general object of the invention is to provide an improved bridge mix and an initiator that is cost effective to manufacture.

A more specific objective of the invention is to overcome one or more of the problems described above.

The general object of the invention can be attained, at least in part, through a low density slurry bridge mix including zirconium metal, a thermal conductivity enhancer, potassium perchlorate and a binder material and which bridge mix has a dry density of about 45 percent to about 65 percent of theoretical density.

The prior art generally fails to provide a ZPP bridge mix that can reproducibly and reliably ignite an associated pyrotechnic composition without requiring compaction or compression of the bridge mix to a dry density of greater than about 80 percent of theoretical density. Further, the prior art has generally failed to provide a low density slurry bridge mix that may be loaded onto and may adhere to a raised bridgewire thereby eliminating the need to provide a charge holder and/or to provide a header that has been ground to provide adequate support for the bridgewire as part of an initiator.

The invention further comprehends an initiator including a raised bridgewire, a low density slurry bridge mix containing zirconium metal, a thermal conductivity enhancer, potassium perchlorate oxidant and an acrylic binder material wherein the low density slurry bridge mix adheres to the raised bridgewire.

The invention still further comprehends a low density slurry bridge mix having adhesive properties effective to adhere the low density slurry bridge mix to an associated bridgewire. The low density slurry bridge mix contains about 25 to about 35 composition weight percent zirconium metal; about 10 to about 20 composition weight percent aluminum metal thermal conductivity enhancer; about 48 to about 65 composition weight percent potassium perchlorate; and about 1.5 to about 5 composition weight percent acrylic binder and wherein the low density slurry bridge mix has a dry density of about 45 to about 60 percent of theoretical density. Advantageously, the low density slurry bridge mix may contain about 10 to about 20 composition weight percent of a metal oxide supplemental oxidant such as cupric oxide.

As used herein, references to "slurry" are to be understood to refer to an injectable suspension of a fine nonsoluble solid material or mixture of materials in a viscous fluid matrix.

As used herein, references to "All Fire (AF)" standard are understood to refer to a level of direct electrical current that will ignite a material, mixture or composition 99.9999% of the time with a 95% confidence level within 2 milliseconds at −40° C. to +23° C. The AF rating for a particular material, mixture or composition may be determined according to the Bruceton Method as disclosed in U.S. Military Standard (MIL-STD) 331B, Test D2 (Projectile Fuze Arming Distance). Typically, the level of direct electrical current applied to the material, mixture or composition is not greater than 1.2 amperes.

Reference herein to the "No Fire (NF)" standard is to be understood to refer to a level of direct electrical current that will not ignite a material, mixture or composition 99.999% of the time with a 95% confidence level when applied for 10 seconds at +23° C. to +85° C. The NF rating of a particular material, mixture or composition may be determined according to the Bruceton Method as disclosed in Military Standard (MIL-STD) 331B, Test D2 (Projectile Fuze Arming Distance). Generally, the maximum direct electrical current applied to the material, mixture or composition should not exceed 400 milliamperes.

Further, references herein to "theoretical density" are to be understood to refer to the theoretical maximum dry density of a material, mixture or composition that can be obtained by compression or compaction.

References herein to an "azeotrope" are to be understood to refer to a mixture of liquids, such as water and alcohol, that evaporates in constant proportion.

Other objects and advantages will be apparent to those skilled in the art from the following detailed description taken in conjunction with the appended claims and drawing.

BRIEF DESCRIPTION OF THE DRAWING

The FIGURE is a cross-sectional view of a single pin initiator including a low density slurry bridge mix of the invention and a raised bridgewire.

DETAILED DESCRIPTION OF THE INVENTION

The present invention provides a low density slurry bridge mix such as for use in an initiator of an inflator device for an inflatable restraint system. Such low density slurry bridge mix typically includes zirconium metal, a thermal conductivity enhancer, potassium perchlorate oxidant and a binder material and has a dry density of about 45% to about 60% of theoretical density.

As will be appreciated, the present invention may be embodied in a variety of different structures. Referring to the FIGURE, there is illustrated a single pin initiator, generally designated by reference numeral 10. The single pin initiator 10 includes a header 12 that forms an eyelet 14 having a central bore therethrough for positioning a pin 16 along at least a portion of a central axis A of the single pin initiator 10. The pin 16 is secured within the eyelet 14 by an insulating seal 18 such as an insulating glass sleeve. Desirably, the header 12 is unground, e.g., added grinding of the header is not required with the practice of the invention.

The single pin initiator 10 also includes a raised bridgewire 20 which spans or extends from a lip end portion 22 of the header 12 and contacts a head portion 24 of the pin 16 to form or provide electrical communication between the pin 16 and the header 12. Desirably, but not necessarily, the raised bridgewire 20 is suitably connected to an upper surface 26 of the head portion 24 of the pin using a conventional mechanical connection such as a resistance weld.

The single pin initiator 10 further includes an initiator canister 28 connected to the header 12 using a suitable mechanical connection such as a laser weld. The initiator canister 28 forms or otherwise defines a storage chamber 30 within which a supply of a pyrotechnic initiator charge material 32 may be stored. The pyrotechnic initiator charge material 32 may contain any suitable materials such as is known to those having skill in the art and guided by the teachings herein provided, with such charge materials generally being combustible or ignitable to produce an output charge. For example, the pyrotechnic initiator charge material 32 may include a zirconium/potassium perchlorate (ZPP) mixture that has been slurry loaded, dried and compressed.

In accordance with the invention, the initiator further includes a low density slurry bridge mix 34 advantageously positioned within storage chamber 30 such that it is in intimate contact with the bridgewire 20. Desirably, the bridgewire 20 is encased or otherwise surrounded by the low density slurry bridge mix 34. Advantageously, the low density slurry bridge mix 34 adheres to the bridgewire 20 and/or the header 12 thereby supporting and protecting the bridgewire, as well as, providing intimate contact between the bridgewire and the bridge mix. Suitably, the low density bridge mix 34 is also positioned adjacent to and in intimate contact with pyrotechnic initiator charge material 32 to facilitate ignition or firing of the initiator 10.

It is generally desirable in the production of initiators and associated bridge mixes to minimize costs and labor. However, as described above, the manufacture of prior art initiators typically includes grinding a header to within a fraction of the diameter of an associated bridgewire, providing and attaching or welding a charge holder to the ground header and compressing a bridge mix onto the header and bridgewire. In general, the header is ground and the charge holder is attached in order to provide support to the bridgewire during the compression step. Previously, bridge mixes containing zirconium and potassium perchlorate (ZPP mixtures) have typically been compressed to a dry density greater than about 80 percent of theoretical density because the porosity of uncompressed ZPP mixtures reduces the ability of the mixture to effectively conduct heat generated by the bridgewire and to reliably ignite the ZPP mixture to meet industry initiator sensitivity requirements such as the All-Fire (AF) and No Fire (NF) standards.

As defined above, the All Fire (AF) standard or rating refers to a level of direct electrical current that will ignite a material, mixture or composition 99.9999% of the time with a 95% confidence level within 2 milliseconds at −40° C. to +23° C. Therefore, an increase in the AF rating for a particular mixture may be measured as a percentage increase in the amount of current applied to the mixture that results in reliable ignition within the above defined parameters.

As defined above, the No Fire (NF) standard or rating refers to a level of direct electrical current that will not ignite a material, mixture or composition 99.999% of the time with a 95% confidence level when applied for 10 seconds at +23° C. to +85° C. Therefore, an increase in the NF rating for a particular mixture may be measured as a percentage increase in the amount of current applied to the mixture that does not result in ignition within the defined parameters. Advantageously, the maximum direct electrical current applied to the material, mixture or composition generally desirably exceeds 400 milliamperes.

Heretofore, a low density slurry bridge mix containing zirconium metal and potassium perchlorate oxidant that meets industry initiator sensitivity requirements such as the All-Fire (AF) and No-Fire (NF) standards has generally been unknown. Furthermore, a low density slurry bridge mix that may be used in an uncompressed state in an initiator with an unground header and a raised bridgewire and without a charge holder has also generally been unknown. However, it has been discovered, that including a thermal conductivity enhancer within the low density slurry bridge mix compensates for the loss of thermal conductivity typically associated with the decrease in density of the more porous ZPP mixture as described above. Thus, an amount of a thermal conductivity enhancer may be included in a ZPP mixture that is effective to increase the thermal diffusivity of the uncompressed ZPP mixture to levels comparable to previously known, highly compressed ZPP mixtures, e.g., compressed to greater than about 80 percent of theoretical density. Moreover, it has been unexpectedly discovered that the inclusion of such a thermal conductivity enhancer in a ZPP mixture results in a proportionately greater increase in the NF rating without an undesirable increase in the AF rating. Previous experience had indicated that the inclusion of such a thermal conductivity enhancer would result in an approximately equivalent percentage increase in both the AF rating as well as the NF rating. For example, a low density slurry bridge mix including an energetic thermal conductivity enhancer such as aluminum metal can result in a 35% increase in the NF rating but only a 1.5% increase in AF rating compared to an uncompressed ZPP mixture without an thermal conductivity enhancer.

Additionally, it has been discovered that such low density slurry bridge mixes including a thermal conductivity enhancer may be used with less sensitive, less expensive and more robust raised bridgewires thereby eliminating the need for a ground header.

In accordance with the invention, the low density slurry bridge mix 34 desirably contains zirconium metal, a thermal conductivity enhancer, potassium perchlorate oxidant and a binder material. Advantageously, the low density slurry bridge mix has a dry density of about 45 to about 65 percent of theoretical density. As identified above, theoretical density refers to the maximum dry density of a compressed mixture, composition or compound.

Suitably, the low density slurry bridge mix includes about 25 to about 35 composition weight percent zirconium metal and about 45 to about 65 composition weight percent potassium perchlorate.

In general, the low density slurry bridge mix of the invention preferably includes at least one thermal conductivity enhancer. Examples of suitable thermal conductivity enhancers include, but are not limited to, thermally conductive, highly exothermic metals such as aluminum, magnesium, tungsten and combinations thereof, and thermally conductive metal oxides such as cupric oxide, gold, silver and palladium oxides, and combinations thereof.

Typically, the low density slurry bridge mix of the invention includes a thermal conductivity enhancer in an amount effective to provide a level of thermal conductivity equivalent to that of a highly compressed zirconium/potassium perchlorate (ZPP) mixture without a thermal conductivity enhancer. For example, in accordance with certain preferred embodiments, the low density slurry bridge mix of the invention includes about 10 to about 20 composition weight percent aluminum metal thermal conductivity enhancer.

The low density slurry bridge mix also contains a binder material. Desirably, the binder material imparts sufficient adhesive properties to the low density slurry bridge mix such that the low density slurry bridge mix adheres or adhesively bonds to an associated bridgewire and/or header. Various binder materials may be included in the low density slurry bridge mix. Desirably, such binder materials should be water-dispersible and durable, have a high viscosity in an alcoholic azeotrope, adhere to the bridgewire in both a wet and dry condition, have a relatively low modulus, exhibit chemical stability both in solution and dried, and be compatible with other components or ingredients of the low density slurry bridge mix. Suitable binder materials include, but are not limited to, acrylic binders, fluoropolymer binders such as are available under the registered trademark VITON from DuPont Dow Elastomers, L.L.C. of Wilmington, Del., U.S.A., cellulosic polymers, soluble nylons, and various block copolymers. Advantageously, the low density slurry bridge mix includes about 1.5 to about 5.0 composition weight percent binder material.

In accordance with certain preferred embodiments of the invention, the low density slurry bridge mix includes an acrylic binder that imparts sufficient adhesive properties to the bridge mix such that the low density slurry bridge mix adheres or adhesively bonds to an associated bridgewire and/or header. Suitable acrylic binders should be compatible with the other components of the low density slurry bridge mix, dry or cure to a robust condition at a concentration as low as about 1.5 composition weight percent, provide acceptable rheology, e.g., viscosity, have sufficient wet grab to prevent the slurry from flowing after application and prior to drying, have adequate temperature stability, and provide acceptable ballistic performance. One particularly suitable acrylic binder contains a mixture of a zinc crosslinked acrylic or modified acrylic polymer emulsion such as RHOPLEX® MC-1834 and an n-butyl acrylate adhesive such as Robond™ PS-2000 both available from the Rohm and Haas Company of Philadelphia, Pa., U.S.A.

In certain embodiments, the low density slurry bridge mix may further include a metal oxide supplemental oxidant. Examples of suitable metal oxide supplemental oxidants include, but are not limited to, cupric oxide, gold, silver and palladium oxides, and combinations thereof. In accordance with certain preferred embodiments, the low density slurry bridge mix may contain cupric oxide supplemental oxidant. Advantageously, the low density slurry bridge mix may contain about 10 to about 20 composition weight percent metal oxide supplemental oxidant.

In accordance with the invention, the low density slurry bridge mix may be prepared by mixing a binder material such as an acrylic binder with a solvent to form a premix.

Suitably, the solvent is an alcohol such as n-propyl alcohol. The use of n-propyl alcohol is believed to be particularly desirable as it provides the low density slurry bridge mix with a suitable viscosity such as a viscosity of about 50,000 to about 250,000 centipoise. Such a viscosity is believed to be desirable to provide suitable rheological properties that allow the slurry bridge mix to flow under pressure such as when loaded into an initiator but also allow the slurry bridge mix to remain stable and in position once applied to a bridgewire and/or header prior to drying. Furthermore, n-propyl alcohol forms an approximate or near azeotrope with water, such as may be contained in the binder material, such as an acrylic binder as described above. Suitably, an amount of n-propyl alcohol is included in the premix to result in an alcohol-rich mixture such as to minimize or avoid the presence of water without the alcohol as the presence of such alcohol-free water may result in undesired corrosivity. The solids concentration of the premix may generally be adjusted to provide the desired amount of binder material in the low density slurry bridge mix, e.g., an acrylic binder concentration of about 1.5 to about 5.0 composition weight percent. Thereafter, the desired amounts of the zirconium metal, thermal conductivity enhancer and potassium perchlorate oxidant are added to the premix and the resulting low density slurry bridge mix is stirred or otherwise agitated to disperse the solids evenly throughout the slurry.

The low density slurry bridge mix may then be loaded into a initiator such as described in detail above. Suitably, the low density slurry bridge mix is dried to remove the solvent and any water present to facilitate bonding or attachment of the low density slurry bridge mix to the header and/or the bridgewire.

The present invention is described in further detail in connection with the following example which illustrates or simulates various aspects involved in the practice of the invention. It is to be understood that all changes that come within the spirit of the invention are desired to be protected and thus the invention is not to be construed as limited by these examples.

EXAMPLE

A low density slurry bridge mix in accordance with the invention was prepared as follows. An acrylic binder premix including 15 parts RHOPLEX® MC-1834 acrylic emulsion (47% solids) and 5 parts Robond™ PS-2000 n-butyl acrylate adhesive (54% solids), both available from the Rohm and Haas Company, was prepared. The acrylic binder premix was further mixed with 40 parts n-propyl alcohol to form a uniform slurry premix which was assayed to determine the total solids content. Thereafter, an amount of the slurry premix was weighed out and to this amount was added zirconium metal, aluminum metal conductivity enhancer and potassium perchlorate to yield a low density slurry bridge mix having the composition shown in TABLE 1 below. The resulting low density slurry bridge mix was thoroughly mixed to provide a uniformly dispersed mixture. A portion of the low density slurry bridge mix was dried and combusted to determine the combustion temperature and chemical composition of combustion byproducts. The results are also shown in TABLE 1 below.

TABLE 1

| Components | Composition Weight Percent |
|---|---|
| Zirconium metal | 29.50 |
| Aluminum metal | 15.00 |
| Potassium perchlorate | 53.00 |
| Acrylic binder | 2.50 |
| Total | 100.00 |
| Combustion temperature (K.) | 5000 |
| Combustion byproducts | Moles |
| Zirconium oxide — gas phase | 0.14854 |
| Zirconium oxide — liquid phase | 0.13620 |

As noted above, it is advantageous to provide a low density slurry bridge mix that is adequately buffered to prevent undesirable increases in combustion temperatures which may result in an inflation gas stream having an unacceptably high temperature. A shown in TABLE 1 above, the inclusion of an aluminum metal thermal conductivity enhancer results in a combustion gas stream that includes a higher level of zirconium oxide in the gas phase than in the liquid phase. The higher level of zirconium oxide in the gas phase indicates that a degree of thermal buffering exists that allows for an increased energy output without an increase in the desired combustion temperature of about 5000 K. Such buffering is generally desirable to prevent or otherwise generally avoid undesirable fluctuations in combustion temperature and burn rates.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A low density slurry bridge mix comprising:

about 25 to about 35 compositions weight percent zirconium metal;

about 10 to about 20 composition weight percent thermal conductivity enhancer;

about 45 to about 65 composition weight percent potassium perchlorate oxidant; and about 1.5 to about 5.0 composition weight percent binder material;

wherein the low density slurry bridge mix has a dry density of about 45% to about 65% of theoretical density.

2. The low density slurry bridge mix of claim 1 wherein the thermal conductivity enhancer comprises a metal selected from the group consisting of aluminum, magnesium, tungsten, and combinations thereof.

3. The low density slurry bridge mix of claim 1 wherein the thermal conductivity enhancer comprises a metal oxide selected from the group consisting of cupric oxide, gold, silver and palladium oxides, and combinations thereof.

4. The low density slurry bridge mix of claim 1 wherein the thermal conductivity enhancer comprises aluminum metal.

5. The low density slurry bridge mix of claim 1 having adhesive properties effective to adhere the low density slurry bridge mix to an associated bridgewire.

6. The low density slurry bridge mix of claim 1 wherein the binder material comprises an acrylic binder.

7. A low density slurry bridge mix comprising:

about 25 to about 35 composition weight percent zirconium metal;

about 10 to about 20 composition weight percent aluminum metal thermal conductivity enhancer;

about 48 to about 65 composition weight percent potassium perchlorate oxidant; and about 1.5 to about 5 composition weight percent acrylic binder;

wherein the low density slurry bridge mix has a dry density of about 45% to about 65% of theoretical density.

8. The low density slurry bridge mix of claim 1 further comprising a metal oxide supplemental oxidant.

9. The low density slurry bridge mix of claim 8 wherein the metal oxide supplemental oxidant is selected from the group consisting of cupric oxide, gold, silver, platinum, and palladium oxides, and combinations thereof.

10. The low density slurry bridge mix of claim 8 wherein the metal oxide supplement oxidant comprises cupric oxide.

11. The low density slurry bridge mix of claim 8 comprising about 10 to about 20 composition weight percent metal oxide supplemental oxidant.

12. An electrical initiator comprising:

a raised bridgewire; and the low density slurry bridge mix of claim 1, wherein the low density slurry bridge mix is adhered to the raised bridgewire.

13. The electrical initiator of claim 12 wherein the raised bridgewire is encased in and adhesively bonded to the low density slurry bridge mix.

14. The electrical initiator of claim 12 wherein the thermal conductivity enhancer comprises aluminum metal.

15. The electrical initiator of claim 12 wherein the low density slurry bridge mix comprises:

about 25 to about 35 composition weight percent zirconium metal;

about 10 to about 20 composition weight percent aluminum metal thermal conductivity enhancer;

about 48 to about 65 composition weight percent potassium perchlorate oxidant; and about 1.5 to about 5 composition weight percent acrylic binder.

16. The electrical initiator of claim 12 wherein the low density slurry bridge mix further comprises a metal oxide supplement oxidant.

17. The electrical initiator of claim 16 wherein the metal oxide supplemental oxidant is selected from the group consisting of cupric oxide, gold, silver, platinum and palladium oxides, and combinations thereof.

18. The electrical initiator of claim 17 wherein the metal oxide supplemental oxidant comprises cupric oxide.

19. The electrical initiator of claim 16 wherein the low density slurry bridge mix comprises about 10 to about 20 composition weight percent metal oxide supplemental oxidant.

20. The electrical initiator of claim 12 further comprising an unground header.

21. The electrical initiator of claim 20 wherein the low density slurry bridge mix has adhesive properties effective to adhere the low density slurry bridge mix to the unground header.

22. A low density slurry bridge mix having adhesive properties effective to adhere the low density slurry bridge mix to an associated bridgewire comprising:

about 25 to about 35 composition weight percent zirconium metal;

about 10 to about 20 composition weight percent aluminum metal thermal conductivity enhancer;

about 48 to about 65 composition weight percent potassium perchlorate oxidant;

about 10 to about 20 composition weight percent metal oxide supplemental oxidant; and about 1.5 to about 5 composition weight percent acrylic binder;

wherein the low density slurry bridge mix has a dry density of about 45% to about 60% of theoretical density.

23. The low density slurry bridge mix of claim 22 wherein the metal oxide supplemental oxidant comprises cupric oxide.

24. The low density slurry bridge mix of claim 7 further comprising a metal oxide supplemental oxidant.

25. The low density slurry bridge mix of claim 24 wherein the metal oxide supplemental oxidant is selected from the group consisting of cupric oxide, gold, silver, platinum, and palladium oxides, and combinations thereof.

26. The low density slurry bridge mix of claim 24 wherein the metal oxide supplement oxidant comprises cupric oxide.

27. The low density slurry bridge mix of claim 24 comprising about 10 to about 20 composition weight percent metal oxide supplemental oxidant.

* * * * *